US009677245B2

(12) United States Patent
Doherty et al.

(10) Patent No.: US 9,677,245 B2
(45) Date of Patent: Jun. 13, 2017

(54) COUPLER

(71) Applicant: Doherty Engineered Attachments Limited, Mount Maunganui (NZ)

(72) Inventors: Paul James Doherty, Papamoa Beach (NZ); Jeremy Glen Doherty, Papamoa Beach (NZ)

(73) Assignee: Doherty Engineered Attachments Limited, Mount Maunganui (NZ)

( * ) Notice: Subject to any disclaimer, the term of this patent is extended or adjusted under 35 U.S.C. 154(b) by 0 days.

(21) Appl. No.: 14/844,481

(22) Filed: Sep. 3, 2015

(65) Prior Publication Data

US 2016/0153164 A1 Jun. 2, 2016

Related U.S. Application Data

(62) Division of application No. 13/499,046, filed as application No. PCT/NZ2010/000192 on Sep. 29, 2010, now Pat. No. 9,206,582.

(30) Foreign Application Priority Data

Sep. 29, 2009 (NZ) ..... 579987

(51) Int. Cl.
*E02F 3/36* (2006.01)

(52) U.S. Cl.
CPC ..... *E02F 3/3618* (2013.01); *E02F 3/365* (2013.01); *E02F 3/3622* (2013.01); *E02F 3/3627* (2013.01); *E02F 3/3659* (2013.01); *E02F 3/3663* (2013.01); *Y10T 29/49826* (2015.01); *Y10T 403/591* (2015.01); *Y10T 403/593* (2015.01)

(58) Field of Classification Search
CPC ..... E02F 3/3604; E02F 3/3609; E02F 3/3618; E02F 3/3627; E02F 3/365; E02F 3/3663
USPC ..... 414/723; 403/321, 322.1, 322.3; 37/468
See application file for complete search history.

(56) References Cited

U.S. PATENT DOCUMENTS

| | | | |
|---|---|---|---|
| 5,382,110 | A | 1/1995 | Perotto et al. |
| 5,456,030 | A | 10/1995 | Barone et al. |
| 6,233,852 | B1 | 5/2001 | Pemberton |
| 6,422,805 | B1 | 7/2002 | Miller |
| 6,964,122 | B2 | 11/2005 | Cunningham et al. |
| 2007/0166143 | A1 | 7/2007 | Hart et al. |
| 2008/0175657 | A1 | 7/2008 | Fatemi |
| 2008/0193210 | A1 | 8/2008 | Beales |
| 2010/0247228 | A1 | 9/2010 | Monaghan et al. |

FOREIGN PATENT DOCUMENTS

WO 2008029112 3/2008

*Primary Examiner* — Josh Skroupa
(74) *Attorney, Agent, or Firm* — Lewis Kohn & Walker LLP; David M. Kohn; Kari Moyer-Henry

(57) ABSTRACT

A locking mechanism to secure a coupler's jaw, and a coupler incorporating the locking mechanism.

21 Claims, 9 Drawing Sheets

1

1

COUPLER

PRIORITY CLAIM

This application is a Divisional Patent Application claiming priority from U.S. National Stage application Ser. No. 13/499,046 filed on Mar. 29, 2012, which claims the benefit of priority under 35 U.S.C. 371 from International Patent Application No. PCT/NZ2010/000192 filed Sep. 29, 2010, which claims the benefit of priority from New Zealand Patent Application Serial No. 579987 filed Sep. 29, 2009, the entire contents of which are herein incorporated by reference.

TECHNICAL FIELD

The present invention relates to a coupler.

BACKGROUND ART

A coupler is a device used to secure a work attachment to a work vehicle. They generally have jaws that receive pins on the work attachment.

At least one of the jaws is moved by an actuator. This allows the jaws to engage and release the pins thereby securing and releasing the work attachment to the coupler as required.

The actuator applies a driving or engagement force to the moveable jaw to retain the pin therein. Generally another jaw of the coupler faces in the opposite direction to the moveable jaw. Therefore the driving/engagement force of the actuator also forces another pin on the work attachment into another jaw of the coupler.

However, if the actuator fails then the moveable jaw can move and release the pin. This is referred to as lack of engagement force and provides a significant health and safety risk. There have been a number of recent high profile accidents involving failures such as this causing injury to people.

Lack of engagement force is caused by failure of an actuator. This can be for several reasons including loss of hydraulic pressure through leaks or other damage.

Therefore, it is known to have locking systems to secure a moveable jaw. These protect against failure of actuators by securing the moveable jaw with respect to the coupler to retain the pin in the jaw.

One example of these devices is that disclosed in PCT Application No. GB/2007/003324 to Miller UK Limited.

This coupler has a main body to support a pivotal locking member. The locking member prevents a pivoting jaw from moving should the actuator fail. This is achieved by gravity biasing the locking member downwards so that it abuts the jaw thereby holding this and preventing release of the pin.

The locking mechanism of the Miller coupler can be released by moving the coupler through a number of steps. These steps involve inverting the coupler so that gravity causes the member to pivot away from the jaw. This allows the jaw to be retracted by the actuator.

However, it is an inherent problem of this type of coupler that this must be inverted to enable the jaw to release the pin. This means that it can be a time consuming and awkward process to release the work attachment from the coupler.

In addition, relying on gravity to move the locking member means that the system is not fail safe. For instance, dirt or debris may hinder movement of the locking member and prevent securing and/or releasing the jaw.

Yet a further failing of the available couplers is that they are generally configured to work attachments having a predetermined pin separation. Therefore the couplers are not able to be used with different work attachments where the pin spacing varies. This can be a significant limitation on the available couplers.

An additional limitation to the effectiveness of similar devices is that they are designed specifically for use with a fixed coupler. Many modern couplers now incorporate a tilting section which permits the attachment to be angled up to 90 degrees in each direction. Any angle less than perpendicular will reduce the effectiveness of a gravity operated locking member. Therefore, it would be advantageous to have a locking mechanism to secure a jaw with respect to a coupler to ensure that a pin is retained therein.

In addition, it would be advantageous to have a coupler which addresses the issues with the prior art.

Alternatively it is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

DISCLOSURE OF THE INVENTION

According to one aspect of the present invention, there is provided a coupler, including:

a body, a jaw to receive a pin of a work attachment and thereby secure the work attachment to the coupler, an actuator to move the jaw with respect to the body, and a locking mechanism to secure the jaw with respect to the work attachment, characterised in that the actuator moves the locking mechanism to a release position prior to moving the jaw.

According to another aspect of the present invention, there is provided a method of securing a work attachment to a coupler, including the steps of:

(a) using an actuator to move a jaw of the coupler so as to engage a pin on the work attachment;

(b) using a locking mechanism to secure the jaw with respect to the body;

(c) causing the actuator to move the jaw;

the method characterized by the step of (d) moving the actuator to the locking mechanism so as to move the locking mechanism to a release position prior to it moving the jaw at step (c).

According to another aspect of the present invention, there is provided a coupler, including:

a body, a jaw to receive a pin of a work attachment and thereby secure the work attachment to the coupler, an actuator to move the jaw with respect to the body, and a locking mechanism to secure the jaw with respect to the work attachment, characterised in that the locking mechanism secures the jaw with respect to the work attachment to prevent movement of the jaw in the case of loss of engagement force in the actuator.

In a preferred embodiment the present invention may be incorporated to the improved coupler subject of the applicant's co-pending New Zealand Patent Application No. 572477. However, this should not be seen as limiting and the present invention can be incorporated into other couplers.

In a particularly preferred embodiment the present invention is used with the "primary jaw" of a coupler and reference will be made herein.

The term "primary jaw" is a term of the art generally understood as referring to a moveable jaw of a coupler. This should be understood by those skilled in the art.

Preferably, the machine may be an excavator or other construction vehicle. Reference herein will be made to the machine as an excavator.

However, the present invention can be used with other types of machines where releasable work attachments are utilised, including graders and bulldozers, loaders, tractors, and scrapers.

Throughout the present specification, reference to the term "work attachment" should be understood as meaning an implement for performing a task.

Work attachments generally include two or more pins engaged by the coupler's jaws. That engagement secures the work attachment to the machine.

In a preferred embodiment the work attachment may be a digger bucket as should be known to those skilled in the art.

Alternatives for the work attachment include vibration compactors, and grapples used in the forestry industry for grasping and manipulating logs, hole boring augers, clamps, rotating buckets, work platforms, mowers, and hedge cutters.

However the foregoing should not be seen as limiting and alternatives are envisaged. These include graders and bulldozers, loaders, tractors, and scrapers.

Throughout the present specification reference to the term "coupler" should be understood as meaning an assembly to secure a work attachment to an excavator.

This should be known to those skilled in the art.

In a preferred embodiment the coupler has two jaws facing in opposite directions. However it is also envisaged that the jaws could face in the same direction. The jaws will be discussed in more detail below.

In a preferred embodiment the coupler may have a body to hold and/or support the components of the coupler.

In a preferred embodiment the body may be moveably mounted to an excavator arm. This may occur using techniques or components as should be known to those skilled in the art including a quick hitch.

In a preferred embodiment the body may include a path to allow movement of the jaw with respect to the body. The path may be a channel and/or cavity through which the jaw can move. This aspect should become clearer from the following description.

However, the foregoing should not be seen as limiting and alternatives are envisaged. These include embodiments where the body does not include a path where the jaw is external to the body.

Throughout the present specification reference to the term "jaw" should be understood as meaning a component to engage the pin of a work attachment. This should be known to those skilled in the art.

In a preferred embodiment one of the jaws is moveable with respect to the body while one of the jaws is formed in the body.

In a particularly preferred embodiment, the moveable jaw may be formed in, or attached to, a slide. In this embodiment the slide moves within the path in the body.

However alternatives are envisaged including a pivoting jaw, or a jaw external to the body.

Throughout the present specification reference to the term "actuator" should be understood as meaning a component that can move the jaw with respect to the body.

In a preferred embodiment the actuator may be a hydraulic cylinder as should be known to those skilled in the art.

However, the actuator may also be a pneumatic cylinder, a helical actuator, a threaded manual actuator, or chain drive assemblies. Therefore, the foregoing should not be seen as limiting.

In a particularly preferred embodiment the hydraulic cylinder may be connected to the locking mechanism such that deliberate movement of the actuator moves the locking mechanism to a release position. This allows the actuator to move the jaw with respect to the body. This should become clearer from the following description.

Throughout the present specification reference to the term "locking mechanism" should be understood as referring to a component to secure the jaw with respect to the body.

In a preferred embodiment, the locking mechanism may help to ensure that a pin is sufficiently held within the moveable jaw so that the work attachment does not disengage from the coupler in the case of loss of engagement force in the actuator. However in normal operation as the actuator moves the jaw, it moves the locking mechanism to the release position thereby allowing the jaw to move so as to release the pin.

In a particularly preferred embodiment the actuator is connected or linked to, the locking mechanism. That connection or link helps to ensure that the locking mechanism does not move to a release position until there is deliberate movement of the actuator.

The term "deliberate movement" refers to movement intended by the excavator operator.

Preferably the connection of the locking mechanism and actuator is such that the actuator can move slightly without moving the locking mechanism to the release position. This ensures that if the actuator contracts (or expands) due to loss of engagement force that it will not move the locking mechanism to the release position.

However, in the preferred embodiment deliberate movement of the actuator can still move the locking mechanism to the release position thereby allowing the jaw to move.

This feature is useful in protecting against loss of engagement force which would otherwise result in the jaw releasing the pin causing the work attachment to disengage.

In a preferred embodiment the locking mechanism is formed from member(s) and/or pawls which engage with recess(es).

In a particularly preferred embodiment, the member(s) and/or pawls are pivotally mounted to the jaw or body. The member(s) can therefore extend into the recess(es) on the body or jaw, thereby securing the jaw with respect to the body.

In a particularly preferred embodiment the locking member(s) and/or pawls are biased into a locking position. This may be achieved using biasing elements such as springs or compressible material detents. These components apply an urging force to the locking member(s) forcing these towards the recesses. Therefore once the pawls and/or locking members align with the recess they engage.

However this should not be seen as limiting as alternatives are envisaged.

In a particularly preferred embodiment the locking mechanism may be multi-centred.

The term "multi-centred" should be understood as meaning that the locking mechanism can function with variations in pin spacing on work attachments.

For instance, the locking mechanism can secure the jaw at different positions along the length of the path.

In a preferred embodiment this may be achieved by having multiple recess(s) along the length of the path. The member(s) and/or pawls engage the recess(es) to secure the jaw.

This is advantageous as it allows the locking mechanism to operate with different work attachments which may have pins positioned at different spacings.

However the foregoing should not be seen as limiting and alternatives are envisaged. Those include a different mechanism for providing a multi-centred locking mechanism, or couplers that do not have multi-centred locking mechanisms.

BRIEF DESCRIPTION OF DRAWINGS

Further aspects of the present invention will become apparent from the following description which is given by way of example only and with reference to the accompanying drawings in which.

DETAILED DESCRIPTION OF THE INVENTION

Figure 1:
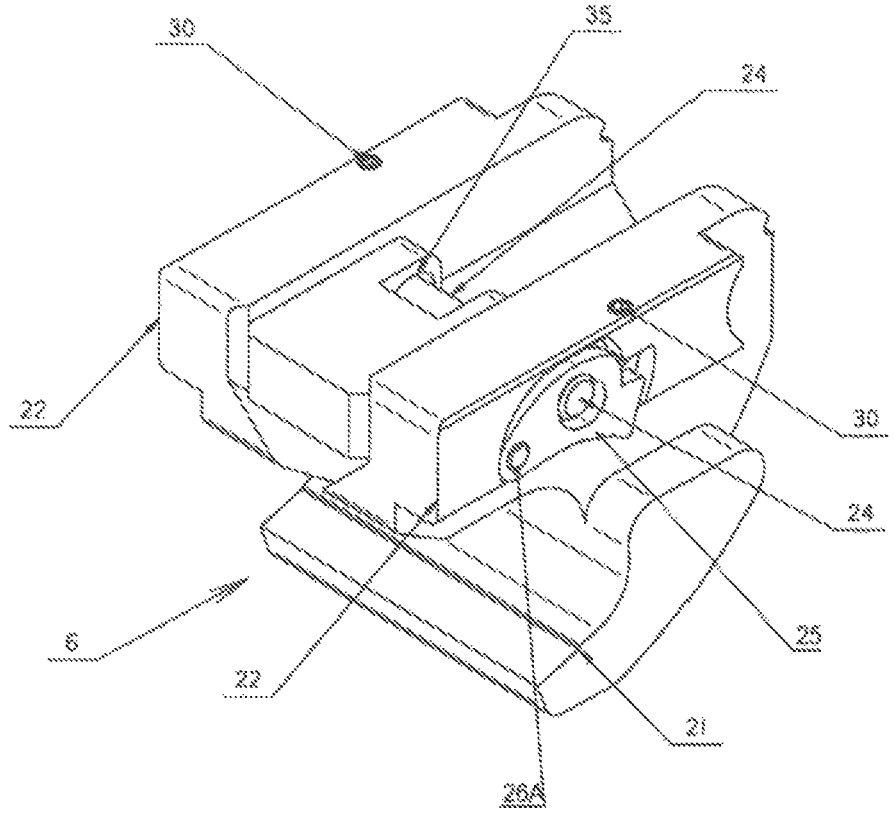
FIG. 1 is an end perspective view of a slide according to the present invention.

The present invention provides an improved coupler 1. The aspects of the coupler 1 will be described by reference to its components in the order in which they are assembled.

A body 2 houses the components of the coupler 1. The body 2 has side walls and end walls 4. The walls 3, 4 define a cavity 5 to receive a slide 6.

Flanges 7, 8 on the body 2 have apertures 9, 10 forming part of a quick hitch (not shown). The quick hitch facilitates securing the coupler 1 to an excavator (not shown). This should be understood by those skilled in the art.

A first end 11 of the body 2 is formed to provide a first jaw 12. The first jaw 12 may include a locking system to secure a pin therein. The locking system is not shown in order to simplify the Figures. However it could be any known or yet to be developed locking system.

A second end 13 of the body 2 has an aperture 14 into the cavity 5.

Figure 2A:
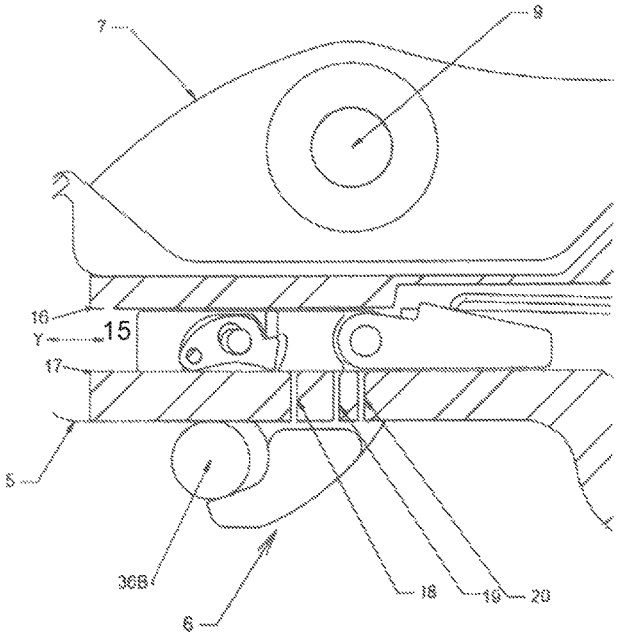
FIG. 2A is a side perspective view of a coupler according to the present invention having a locking mechanism in a release position.
Figure 2B:
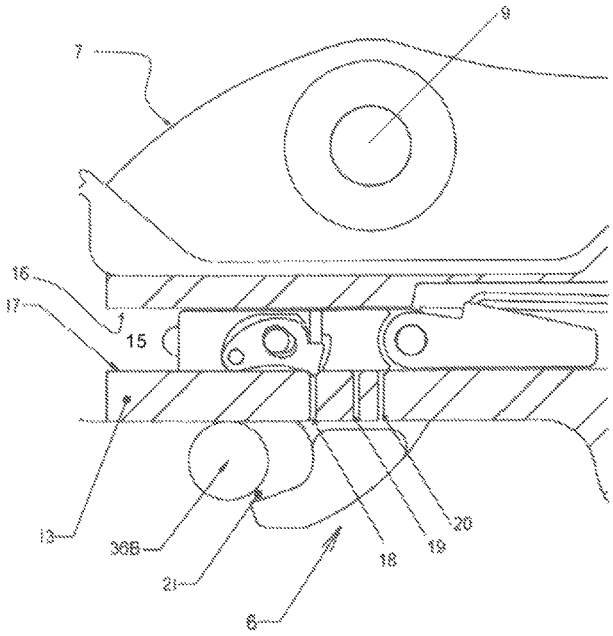
FIG. 2B is a side view of a coupler according to the present invention having a locking mechanism in the locking position.
Figure 3:
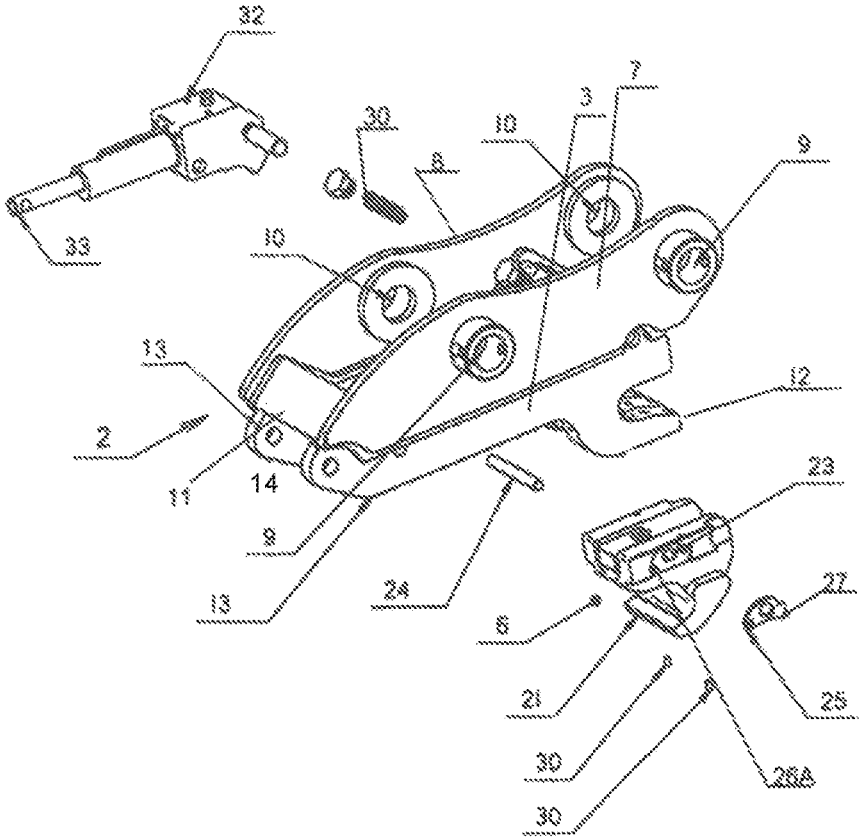
FIG. 3 is an exploded view showing components of the present invention.

The inside of side walls 2 have channels 15 one of which is shown in FIGS. 2A and 2B. Each channel 15 has a top surface 16 and a bottom surface 17.

A row of recesses 18, 19, 20 in the bottom surface 17 are spaced apart along the length of the channel 15. Recesses 18, 19, 20 provide a multi centred locking mechanism as should become clearer from the following description.

The channels 15 define an axis of movement for the slide 6 allowing this to move forward and backwards freely. The axis of movement is shown as line Y.

The slide 6 has a jaw 21. The jaw 21 is the primary jaw of the coupler 1 as should be known to those skilled in the art.

Slide 6 has guide portions 22. The guide portions 22 have a shape corresponding to channels 15. Therefore the guide portions 22 may be disposed in the channels 15. It should be appreciated that the channels 15 define a path to guide movement of the slide 6.

The slide 6 has slot apertures 23. The slot apertures 23 can receive a connection pin 24.

Figure 4:
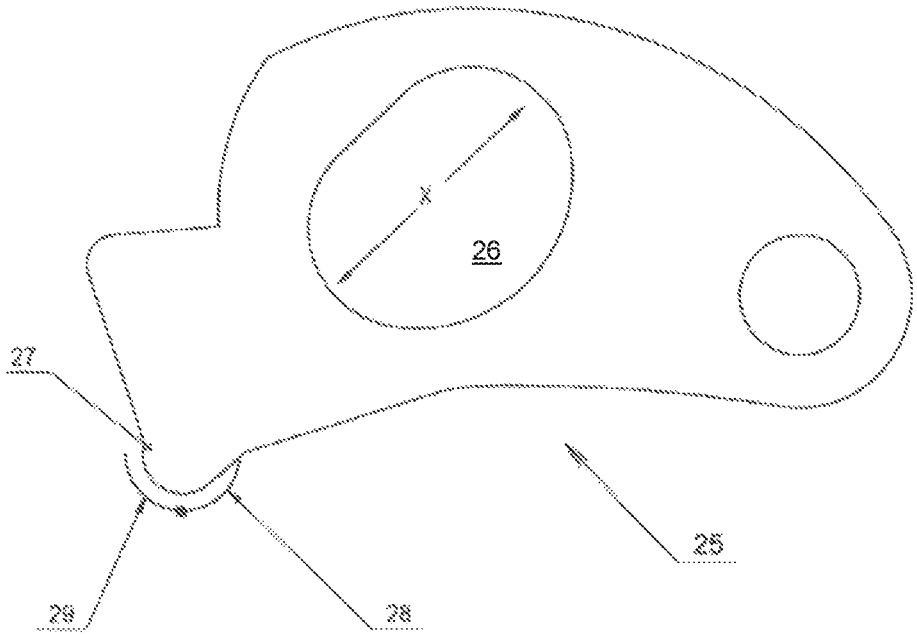
FIG. 4 is a side view of a locking member.

Locking members 25 are pivotally attached to the slide 6 at points 26. The locking members 25 are shown in FIG. 4.

The locking members 25 have a connector aperture 26. The axis of the connector aperture is shown as line X. Axis x is at a 45 degree angle to axis of movement Y.

The locking members 2 have a nub 27. The nub 27 provides a locking edge shown by line 28, and a leading edge shown by line 29.

The leading edge 29 is shaped so that it does not hinder movement of the slide 6 towards the second end 13. The locking edge 28 is shaped so that it stops the slide 6 moving towards end 11 when in the locking position. This should become clearer form the following description.

Biasing elements 30 urge the locking members 25 to pivot around points 31. The biasing elements 30 may be springs or rubber detents.

Connection pin 24 extends through the slot apertures 23 and connection apertures 26.

An actuator 32 in the form of a hydraulic cylinder is positioned inside the cavity 5.

The actuator 32 is connected to a control system (not shown). The control system allows a user to control extension or contraction of the actuator 32.

End 33 of the actuator 32 is secured to the body 2. End 34 of the actuator 32 is connected to the connection pin 24.

The slide 6 has slot apertures 23. The slot apertures 23 are approximately 20% longer than the diameter of the connection pin 24. This provides slack in the connection of the actuator 32 to the locking members 25.

Extension of the actuator 32 moves the slide 6 forward towards second end 13. This will be referred to herein as locking movement.

Contraction of the actuator 32 moves the slide 6 towards first end 11. This will be referred to herein as releasing movement.

The operation of the coupler 1 will now be described with reference to FIGS. 2A and 2B.

The jaw 12 engages a first pin 36A on a work attachment (neither shown in FIG. 2A or 2B). The coupler 1 is rotated about the pin.

The actuator 32 extends to move the slide 6 forward towards end 13. Biasing elements 30 urge locking members 25 towards a locking position. However, the leading edge 29 does not hinder movement of the slide 6 towards end 13.

Movement of the slide 6 continues until the jaw 21 engages pin 36 on a work attachment (not shown). This secures the work attachment to the coupler 1.

At this position the locking members 25 do not engage any of the recesses 18, 19, 20.

The actuator 32 applies a driving or engagement force that ensures that the jaw 12 engages the pin 36B.

The position of the recesses 18, 19, 20 is selected so that these correspond to the positions in which the jaw 21 engages a pin. That is, when the jaw 12 engages a pin 36B the locking members 25 are adjacent to one of the recesses 18, 19, 20.

Note that when the jaw 21 engages pin 36B the nubs 27 do not align with a recess 18, 19, 20.

The work attachment can be used as per normal operation.

If the actuator 32 loses hydraulic pressure the slide 6, and therefore jaw 21, moves along the length of the channels 15 towards end 11. However, this aligns nubs 27 with one of the recesses 18, 19, 20.

The biasing elements 30 urge the locking members 25 to pivot and thereby force nubs 27 into one of the recesses 18, 19, 20. In the embodiment shown in FIG. 2B this is recess 18. This is the locking position.

The locking members 25 secure the slide 6 with respect to the body 2. This protects against loss of engagement force due to failure of the actuator 32.

The connection of the actuator 32 to the slide 6 is such that the locking mechanism secures the slide 6 with respect to the body 2 until deliberate movement of the actuator 32 moves the locking members 25 to the release position. That is, to release the pin 36B from the jaw 21 an operator sends a signal to the actuator 32 to contract. The actuator 32 moves the connection pin 24 along the length of the slot apertures 23 towards end 11. The connection pin 24 presses against the edges of the connector apertures 26. The incline of the connector apertures 26 causes the connection pin 24 to move the locking members 25 thereby drawing the nubs 27 out of recesses 18 and moving the locking members 25 into the release position.

In the release position the slide 6 can move with respect to the body 2 to release the pin 36 and thereby release the work attachment from the coupler 1.

It should be appreciated that the use of multiple recesses 18 which are spaced along the channels 15 allows the locking mechanism to secure the slide 6 jaws 21. This may be beneficial where the coupler 1 is used with work attachments (not shown) having pins 36A, 36B of different spacing. Therefore, were the actuator 32 to fail then the recesses may facilitate a locking member 25 preventing the jaw 12 releasing the pin. Therefore, the coupler 1 and locking mechanism guard against loss of engagement force and may facilitate a coupler being used with different types of, or specification, work implements.

Referring now to FIGS. 5A-E showing an alternate embodiment of the coupler 1. Like numerals are used to refer to like components from FIGS. 1-4.

The components of the coupler 1 are identical to that shown and discussed with reference to FIGS. 1-4. However, the orientation of the locking members 25 and recesses 18, 19, 20 has been altered. That is, the recesses 18, 19, 20 are now in the top surface 16 of the channel 15.

The nubs 27 now face upwards towards top surface 16. The biasing elements 30 urge the locking members 25 to pivot upwards with respect to the slide 6 at points 26. In all other aspects the operation of the coupler shown in FIGS. 5A-E is identical to that shown in FIGS. 1-4.

Figure 5A:
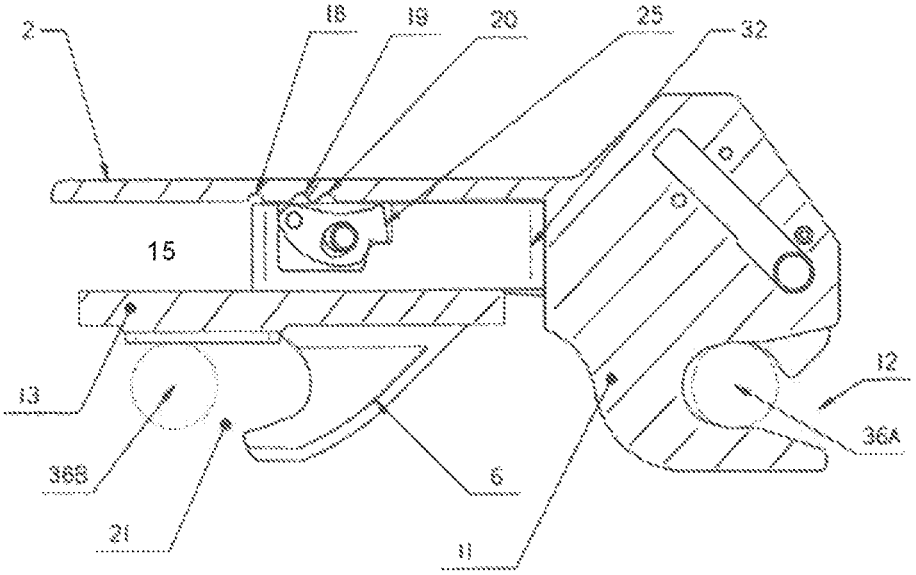
FIGS. 5A-D show a side cross sectional view of an alternate embodiment in operation.

FIG. 5A shows the coupler 1 having the actuator 32 fully contracted. This moves slide 6 so as jaw 21 releases pin 36B. Note that locking member 25 is rotated so that nub 27 does not engage or extend into one of the recesses 18, 19, 20.

Figure 5B:
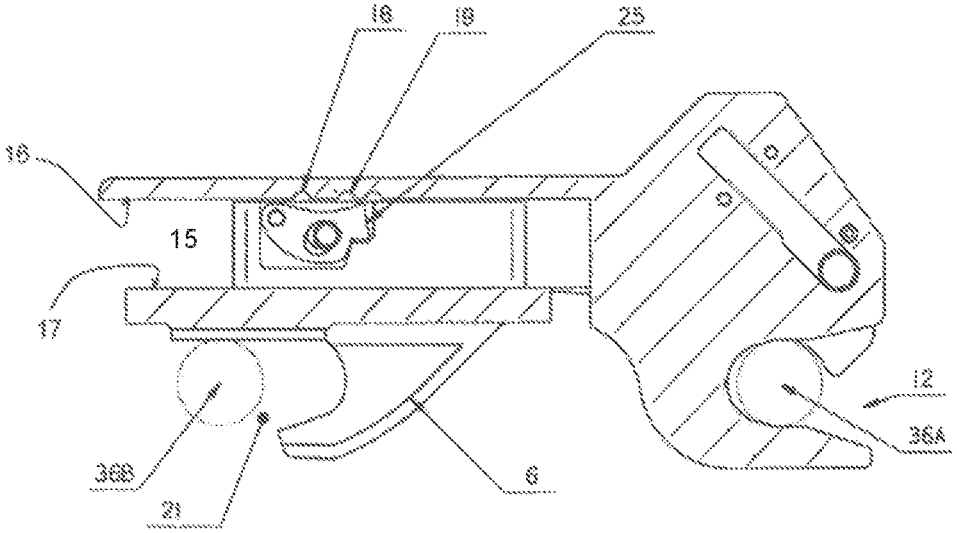

FIG. 5B shows the actuator 32 partly through its stroke. The jaw 21 is moved towards pin 36B.

Figure 5C:
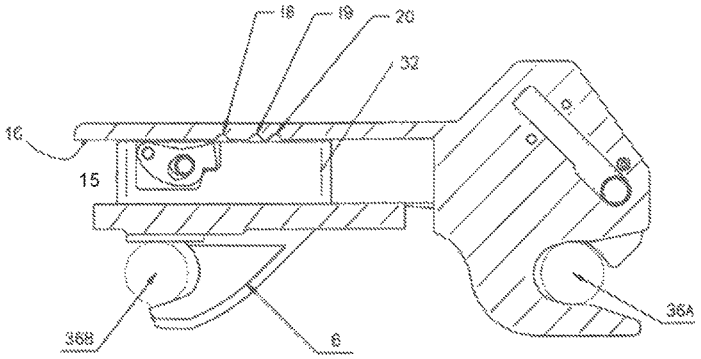
Figure 5D:
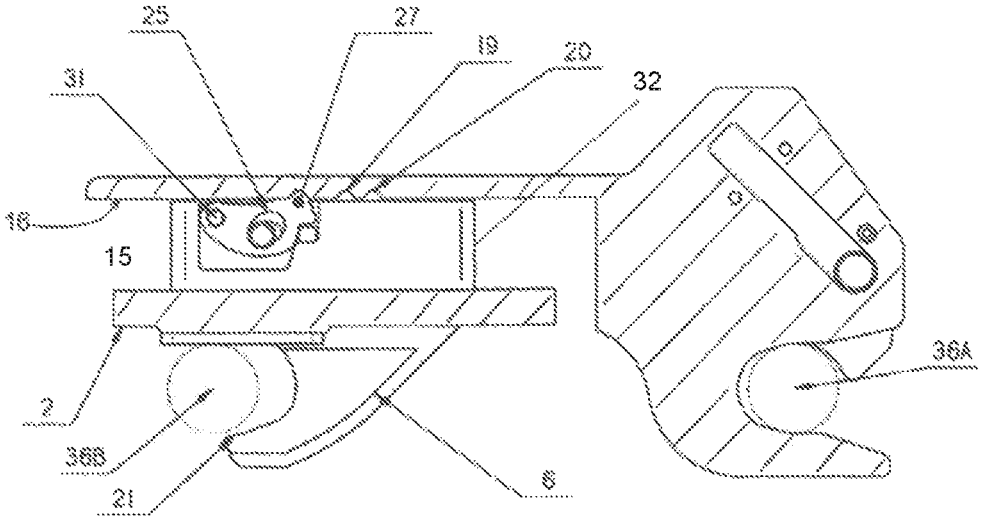

Continued extension of the actuator 32 causes the jaw 21 to engage the pin 36B as shown in FIG. 5C. Note that locking members 25 have been moved past recesses 18, 19, 20. Nub 27 does not align with, nor extend into, any of recesses 18, 19, 20.

If loss of engagement force occurs through failure of actuator 32 slide 6 can move with respect to body 2. This is shown in FIG. 5C. Note that locking member 25 has been moved along the length of path 15 so as nubs 27 align with recess 18.

Biasing elements 30 force locking members 25 so as to pivot upwards towards top surface 16. This causes nubs 27 to extend into recesses 18. The locking member 25 prevents the slide 6 moving further towards end 2. Therefore, the jaw 21 does not fully release pin 36B. Accordingly, the locking mechanism prevents the coupler from releasing the work attachment.

Aspects of the present invention have been described by way of example only and it should be appreciated that modifications and additions may be made thereto without departing from the scope thereof as defined in the appended claims.

What we claim is:

1. A coupler to engage a work attachment that includes a first pin and a second pin, wherein the coupler includes a body, a first jaw to receive the first pin of the work attachment, a moveable jaw, an actuator having a first end and a second end, wherein the second end is connected to the moveable jaw to enable the actuator to expand and contract to move the moveable jaw through a path of movement so as to engage or disengage the second pin on the work attachment, a locking mechanism that can in use ensure that the second pin received in the moveable jaw is sufficiently held within the moveable jaw on loss of engagement force in the actuator, and wherein the actuator is connected to the locking mechanism to enable deliberate expansion or contraction of the actuator to move the locking mechanism to a release position to enable the actuator to move the moveable jaw to disengage the second pin receive therein.

2. The coupler as claimed in claim 1, wherein the moveable jaw is a rear jaw of the coupler.

3. The coupler as claimed in claim 2, wherein the first jaw is a front jaw of the coupler to engage the first pin on the work attachment.

4. The coupler as claimed in claim 3, wherein the first jaw is fixed.

5. The coupler as claimed in claim 3, wherein the moveable jaw and the first jaw are oriented to face in opposite directions to each other.

6. The coupler as claimed in claim 1, including a locking system to secure a pin in the first jaw.

7. The coupler as claimed in claim 1, wherein the multiple positions are predefined positions.

8. The coupler as claimed in claim 1, wherein the body includes aperatures forming part of a quick hitch configured to secure the coupler to an arm of a work vehicle.

9. The coupler as claimed in claim 1, wherein deliberate expansion of the actuator moves the moveable jaw away from the first jaw to thereby cause the moveable jaw to engage the second pin.

10. The coupler as claimed in claim 1, wherein the moveable jaw is a slide.

11. The coupler as claimed in claim 1, wherein the moveable jaw has guide portions which are received in corresponding channel in the body to guide movement of the moveable jaw along its path of movement.

12. The coupler as claimed in claim 1, wherein the moveable jaw includes a recess configured to receive a second pin.

13. The coupler as claimed in claim 1, wherein the locking mechanism comprises:

at least a first recess and a second recess in the body, and wherein the first recess and the second recess are spaced apart from each other along the moveable jaw's path of movement, and at least one locking member mounted to the moveable jaw and which in use can engage the first recess or the second recess to secure the moveable jaw with respect to the body to prevent the moveable jaw moving sufficiently to completely disengage the second pin on loss of engagement force in the actuator.

14. The coupler as claimed in claim 13, wherein in use the at least one locking member engages the first recess and/or second recess to secure the moveable jaw with respect to the body, and wherein the actuator is connected to the locking member(s) so that deliberate expansion or contraction of the actuator moves the locking member(s) to a release position and also moves the moveable jaw.

15. The coupler as claimed in claim 14, wherein the locking member includes a nub which in use can be disposed in the first recess and/or second recess.

16. The coupler as claimed in claim 14, including a third recess spaced apart from the first recess and the second recess along the moveable jaws' path of movement.

17. The coupler as claimed in claim 13, wherein the locking mechanism includes at least one biasing element configured to urge the locking member toward a locked position in which it can engage one of the recesses.

18. The coupler as claimed in claim 1, wherein the actuator comprises a hydraulic cylinder and ram, and wherein the cylinder provides the first end of the actuator and the ram provides the second end of the actuator.

19. The coupler as claimed in claim 18, wherein the ram is connected to a locking member by a slot aperture and a pin disposed in the slot aperture, and further wherein the connection pin is orientated to be substantially perpendicular to an axis defined by a length of the ram.

20. The coupler as claimed in claim 19, wherein the slot aperture has a length that is longer than the diameter of the pin.

21. The coupler as claimed in claim 20, wherein the slot aperture is approximately 20% longer than the diameter of the pin.

* * * * *